US007069741B2

(12) United States Patent
Sishtla

(10) Patent No.: US 7,069,741 B2
(45) Date of Patent: Jul. 4, 2006

(54) ECONOMIZER CHAMBER FOR MINIMIZING PRESSURE PULSATIONS

(75) Inventor: Vishnu M. Sishtla, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 11/053,717

(22) Filed: Feb. 7, 2005

(65) Prior Publication Data

US 2005/0144976 A1 Jul. 7, 2005

Related U.S. Application Data

(63) Continuation of application No. 10/650,300, filed on Aug. 27, 2003, now Pat. No. 6,851,277.

(51) Int. Cl.
*F25B 39/04* (2006.01)
*F25D 19/00* (2006.01)

(52) U.S. Cl. ..... 62/509; 62/296; 62/503

(58) Field of Classification Search ..... 62/509, 62/503, 196.2, 196.4, 498, 513, 296
See application file for complete search history.

(56) References Cited

U.S. PATENT DOCUMENTS

| | | | | |
|---|---|---|---|---|
| 2,312,312 | A | 3/1943 | Beline | |
| 4,035,171 | A | 7/1977 | Reed et al. | |
| 4,232,533 | A | 11/1980 | Lundblad et al. | |
| 4,526,012 | A | 7/1985 | Chigira | |
| 4,899,555 | A | 2/1990 | Shaw | |
| 6,220,050 | B1 | 4/2001 | Cooksey | |
| 6,312,232 | B1 * | 11/2001 | Mori et al. | 417/297 |
| 6,536,230 | B1 | 3/2003 | Coyle et al. | |
| 2002/0184903 | A1 | 12/2002 | Takeuchi et al. | |

FOREIGN PATENT DOCUMENTS

| | | | | |
|---|---|---|---|---|
| DE | 37 05 849 A | | 9/1988 | |
| JP | 56143801 | | 11/1981 | |
| JP | 63199984 A | * | 8/1988 | 251/318 |
| WO | WO 98/15789 A | | 4/1998 | |

* cited by examiner

*Primary Examiner*—Marc Norman

(57) ABSTRACT

A baffle for use in a refrigerator apparatus comprises a baffle plate comprising a first and a second opposing sides attached to an inner surface of the refrigerator apparatus, a baffle seal plate attached along a third side of the baffle plate, the baffle plate seal plate attached to the inner surface of the refrigerator apparatus.

9 Claims, 4 Drawing Sheets

ECONOMIZER CHAMBER FOR MINIMIZING PRESSURE PULSATIONS

CROSS REFERENCE TO RELATED APPLICATIONS

This is a continuation of U.S. patent application Ser. No. 10/650,300 filed Aug. 27, 2003 now U.S. Pat. No. 6,851, 277.

BACKGROUND OF THE INVENTION (1) Field of the Invention

The present invention relates to baffle assembly for use in an economizer chamber for minimizing pressure pulsations.

(2) Description of the Related Art

Float valves are typically used in water cooled chillers to maintain a liquid seal and for controlling coolant flow to the evaporator. In screw chillers, capacity and performance are improved through the use of an economizer cycle. During such a cycle, the economizer flow is introduced into the screw compressor chamber between inlet and outlet ports. As the screw compressor is a positive displacement compressor, it produces high pressure pulsations. The float valve located in the economizer chamber is subjected to these pulsations and can experience failure. What is therefore needed is a design of an economizer which minimizes the pressure pulsations experienced by the float valve.

SUMMARY OF THE INVENTION

Accordingly, it is an object of the present invention to provide a baffle for use in an economizer chamber for minimizing pressure pulsations.

In accordance with the present invention, a baffle for use in a refrigerator apparatus comprises a baffle plate comprising a first and a second opposing sides attached to an inner surface of the refrigerator apparatus, a baffle seal plate attached along a third side of the baffle plate, the baffle seal plate attached to the inner surface of the refrigerator apparatus.

DETAILED DESCRIPTION

Figure 1:
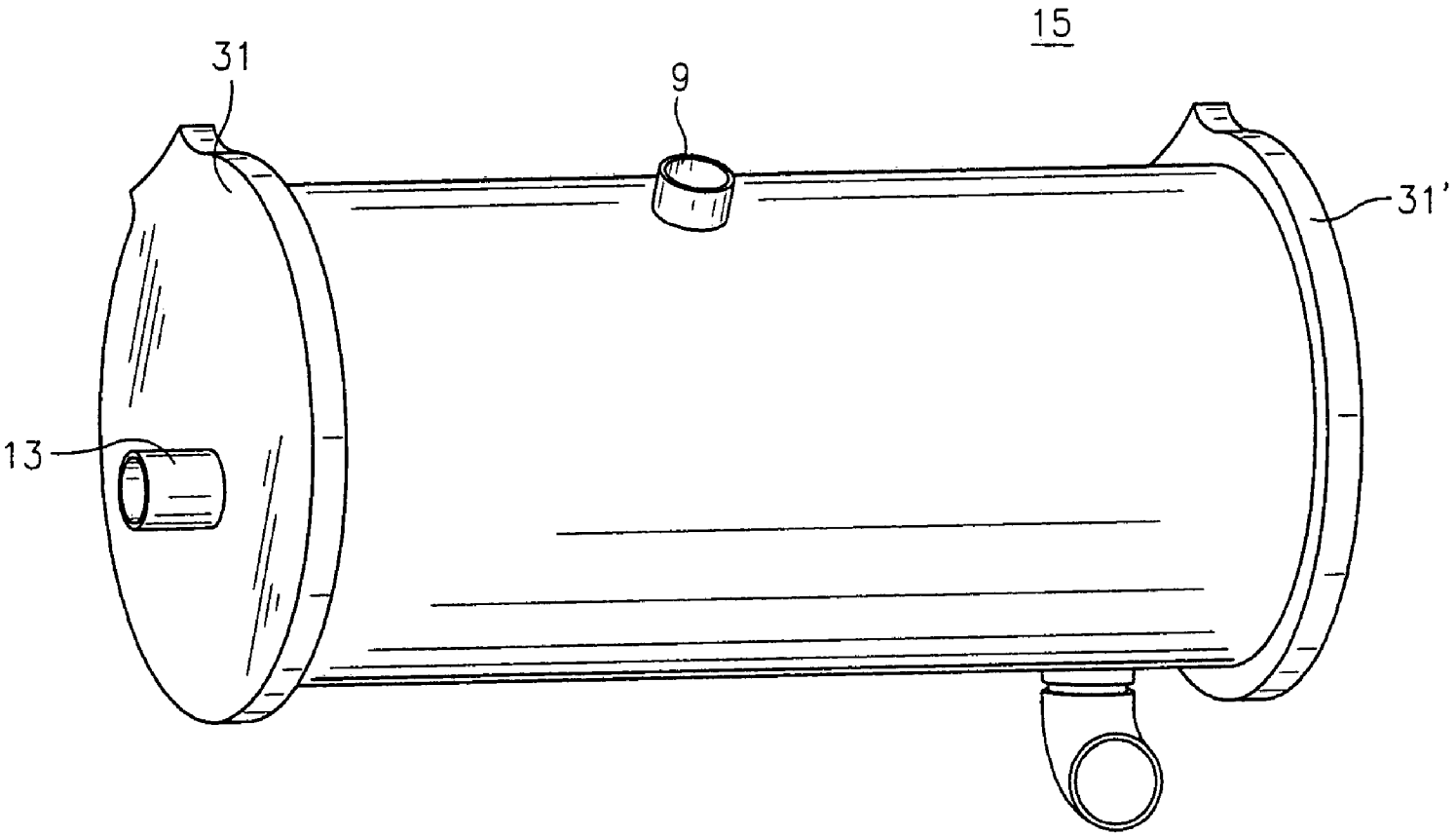
FIG. 1 (PRIOR ART)
FIG. 1 is a perspective illustration of an economizer known in the art.

It is therefore a central purpose of the present invention to provide a baffle for use in an economizer which serves to substantially reduce in intensity the magnitude of the pulsations experienced by a float valve. With reference to FIG. 1, there is illustrated an economizer 15 known in the art. The economizer 15 is substantially cylindrical in nature terminated at both ends by end plates 31, 31'. Extending through one of the end plates 31 is spray pipes 13 which transmits fluid and gas from the condenser. Exiting from the body of the economizer 15 is discharge pipe 9. Discharge pipe 9 carries gas to the compressor.

Figure 2:
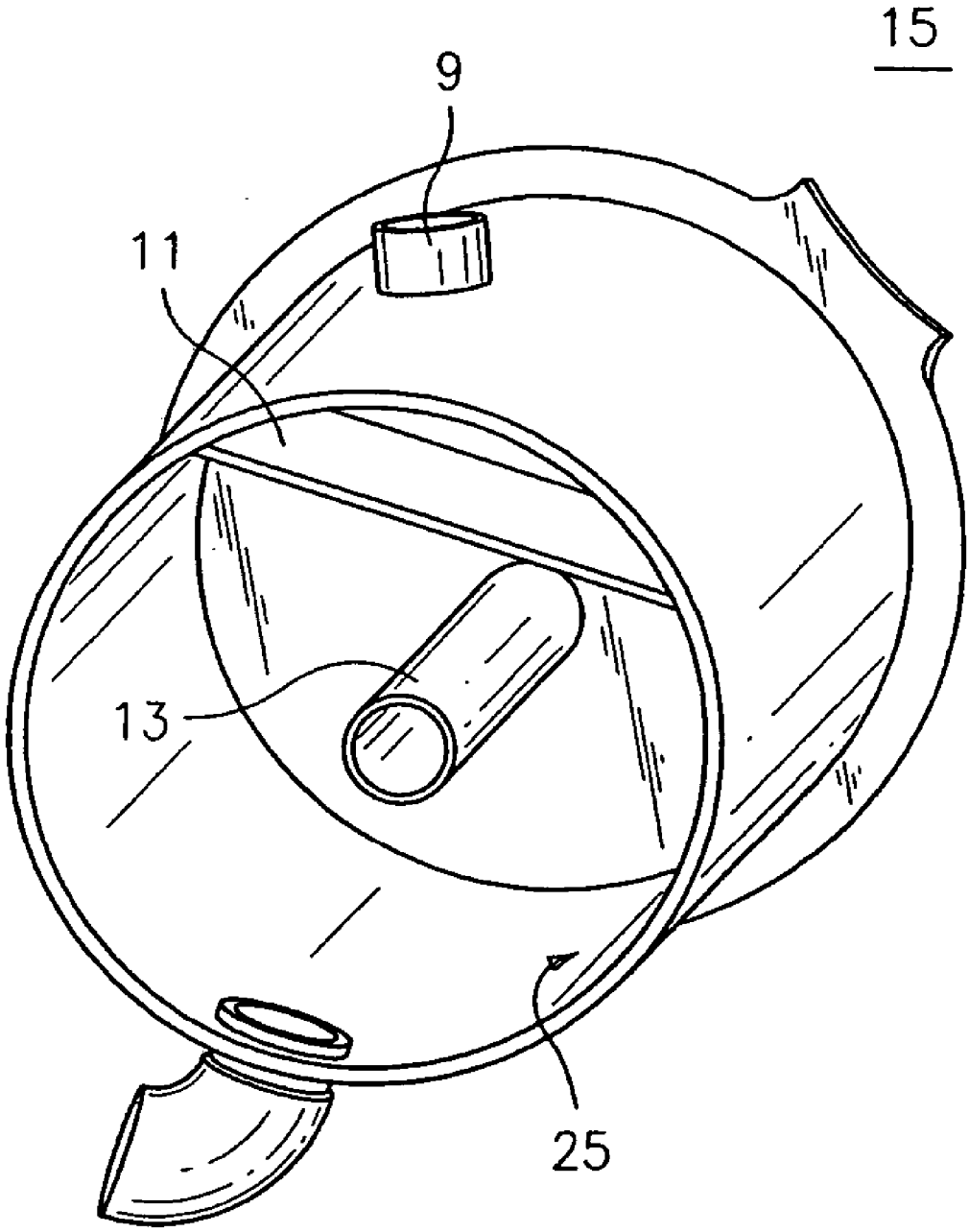
FIG. 2 is a perspective illustration of an economizer of the present invention

With reference to FIG. 2, there is illustrated the inside of an economizer 15 of the present invention showing more clearly the composition of the spray pipe 13. As is evident, spray pipe 13 extends in a direction generally perpendicular to either one of the end plates 31, into the interior cavity of the economizer 15 bonded by the inner surface 25 of the economizer 15. A series of orifices, or perforations, extend through the discharge pipe 9 through which liquid may be transmitted from inside spray pipe 13 into the interior cavity of the economizer 15. There is further illustrated the baffle plate 11 of the present invention. Baffle plate 11 is a generally planer member having at least two opposing parallel sides or edges. These two parallel sides are attached along the inner surface 25 of the economizer 15. In the preferred embodiment illustrated, baffle plate 11 is welded to the sides of the economizer 15.

Figure 3:
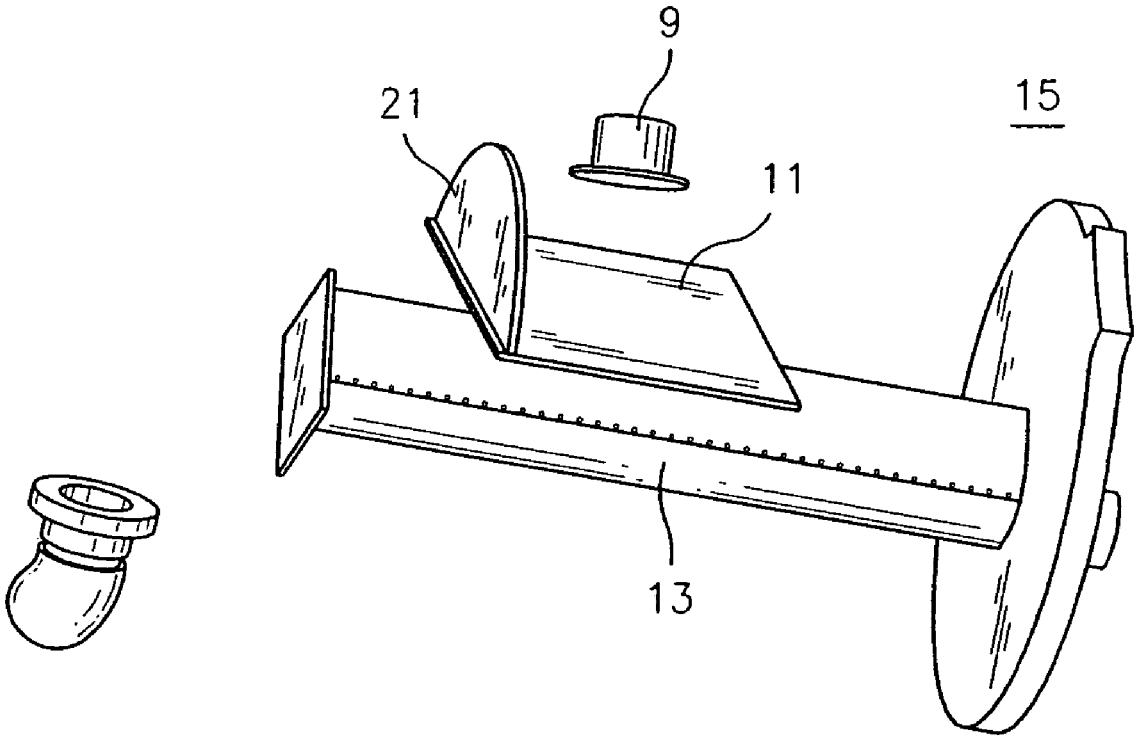
FIG. 3 is an exploded view of the baffle of the present invention.
Figure 5:
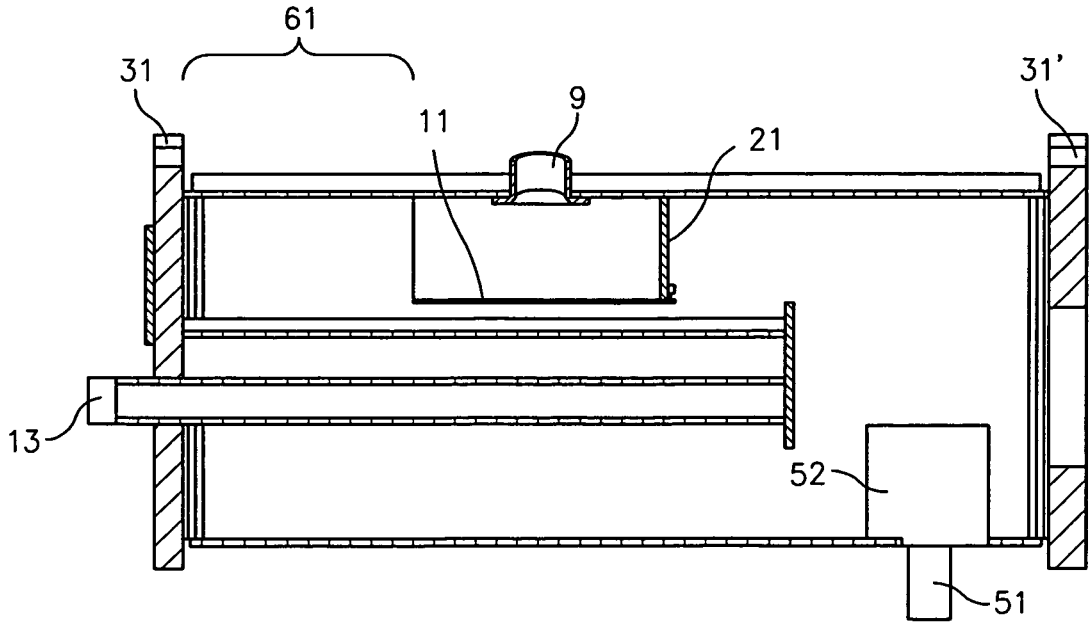
FIG. 5 is a diagram of the baffle of the present invention.

With reference to FIG. 3, there are illustrated the central elements of the present invention without the outer shell of the economizer 15. In the preferred embodiment illustrated, baffle plate 11 is aligned along the axis of discharge pipe 9 such that baffle plate 11 is interposed between spray pipes 13 and discharge pipe 9. As noted above there is a float valve suspended at a terminus of discharge pipe 51 which is schematically illustrated at 52 (FIG. 5). In a preferred embodiment, baffle plate 11 is further attached along one edge to a baffle seal plate 21. Baffle seal plate 21 is preferably welded to baffle plate 11 along a single edge of baffle seal plate 21. In addition, baffle seal 21 is welded along a continuous, alternate edge to the inner surface of the economizer 15. In this manner a concavity is created by the baffle plate 11, the baffle seal plate 21 and the inner surface 25 of the economizer 15. The concavity thus formed is continuous and preferably without interruption or perforations. The path of gas from the economizer to the compressor is shown by arrows in FIG. 5.

In normal operation, liquid from the condenser enters into the economizer 15 chamber which is maintained at a lower pressure by the compressor. The liquid traveling into the spray pipe 13 expands into a two-phase flow with the vapor going into the compressor where it is compressed to higher pressure and is discharged into the condenser. This is achieved by movement of the liquid through the perforations in the spray pipe 13 as described above. Liquid from the economizer 15 chamber travels via a float valve In normal operation, liquid from the condenser enters into the economizer 15 chamber which is maintained at a lower pressure by the compressor. The liquid traveling into the spray pipe 13 expands into a two-phase flow with the vapor going into the compressor where it is compressed to higher pressure and is discharged into the condenser. This is achieved by movement of the liquid through the perforations in the spray pipe 13 as described above. Liquid from the economizer 15 chamber travels via a float valve 52 which is schematically illustrated through discharge pipe 51. In the absence of the baffle plate 11 of the present invention, the pressure pulsations in the economizer chamber are substantial. These pulsations result in a high deflection of the float valve. schematically illustrated through discharge pipe 51. In the absence of the baffle plate 11 of the present invention, the pressure pulsations in the economizer chamber are substantial. These pulsations result in a high deflection of the float valve.

Figure 4:
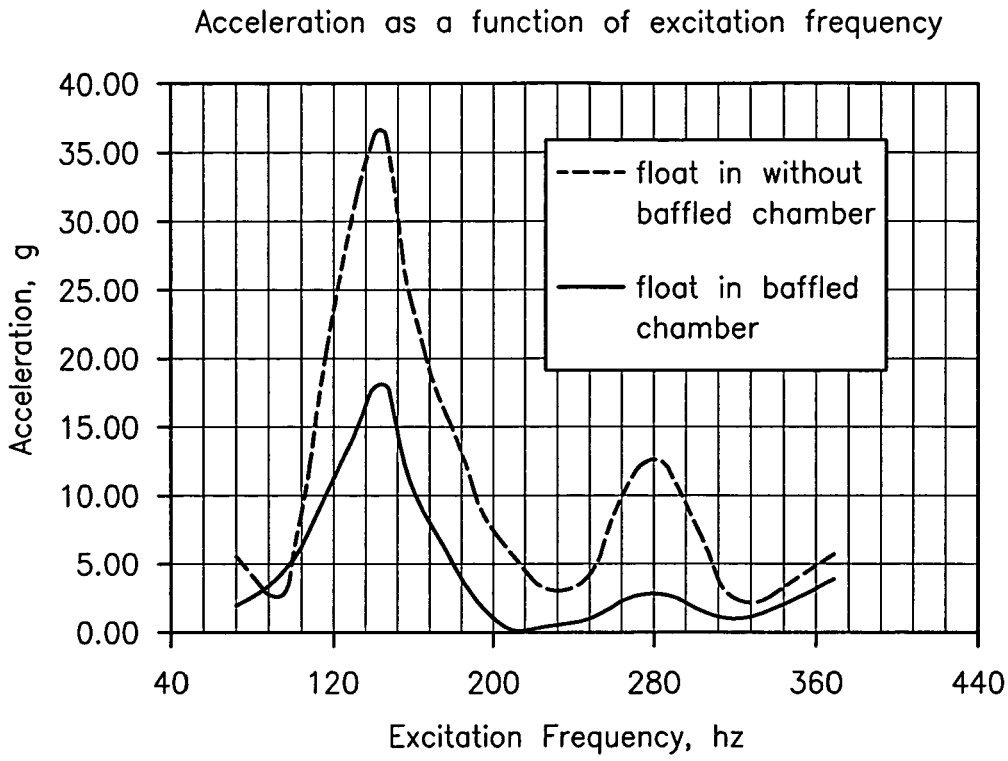
FIG. 4 is a graph of acceleration experienced by a float valve both with and without the baffle of the present invention.

However, the baffle of the present invention, comprised of the baffle plate 11 and the baffle seal plate 21, acts as a barrier to reduce the pressure pulsations felt by the float valve and hence reduces the force experienced by the float valve. With reference to FIG. 4 there is illustrated the acceleration experienced by a float valve in an economizer 15. FIG. 3 is a graph of the excitation frequency of the input pulsations versus the acceleration experience of the float valve both with a baffle and without a baffle. As is evident, there is a significant diminution in the acceleration experience by the float valve in the instance when the baffle of the present invention is added to the economizer 15.

With reference to FIG. 5, there is illustrated in cross-section the baffle of the present invention. Note that baffle plate 11 is separated from end plate 31 by a distance 51. Baffle plate 11 is offset from endplate 31 by a distance 61 sufficient to position baffle plate 11 between spray pipe 13 and discharge pipe 9.

It is apparent that there has been provided in accordance with the present invention an economizer chamber for minimizing pressure pulsations which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. An economizer assembly, comprising:

an economizer chamber having an outlet to a compressor, a liquid outlet and an inlet; and a baffle structure positioned between said outlet to said compressor and said liquid outlet to dampen at least one flow pulsation from said outlet to said compressor.

2. A refrigerator component, comprising:

a chamber having a first port communicated with a compressor and a second port having a float valve; and a baffle assembly positioned between the first port and the second port, whereby the baffle assembly protects the second port from pulsations entering the chamber from the first port.

3. The apparatus of claim 2, wherein the baffle assembly comprises a baffle plate having first and second opposing sides attached to an inner surface of said chamber; and a baffle seal plate attached along a third side of said baffle plate, said baffle seal plate attached to said inner surface of said chamber.

4. The apparatus of claim 3 wherein said baffle plate, said baffle seal plate, and said inner surface define a concavity.

5. The apparatus of claim 4 wherein a discharge pipe extends from a portion of said inner surface forming said concavity.

6. The apparatus of claim 4 wherein said baffle plate is welded to said inner surface.

7. The apparatus of claim 4 wherein said baffle seal plate is welded to said baffle plate.

8. The apparatus of claim 4 wherein said baffle seal plate is welded to said inner surface.

9. The apparatus of claim 3 wherein said refrigerator component comprises an economizer.

* * * * *